US006138296A

United States Patent [19]

Baker

[11] Patent Number: 6,138,296

[45] Date of Patent: Oct. 31, 2000

[54] EASY CONNECT AND DISCONNECT FAUCET SPOUT ASSEMBLY

[75] Inventor: Scott C. Baker, Stevenson Ranch, Calif.

[73] Assignee: Emhart Inc., Newark, Del.

[21] Appl. No.: 09/338,872

[22] Filed: Jun. 23, 1999

[51] Int. Cl.[7] ..... E03C 1/04

[52] U.S. Cl. ..... 4/678

[58] Field of Search ..... 4/675–678; 137/801

[56] References Cited

U.S. PATENT DOCUMENTS 5,361,431 11/1994 Freier et al. ..... 4/678 X 5,946,746 9/1999 Bloom ..... 4/675

*Primary Examiner*—Charles E. Phillips

*Attorney, Agent, or Firm*—Edward D. Murphy

[57] ABSTRACT

A faucet spout assembly 20 is mountable on a deck 80 from above the deck 80. The assembly 20 is connected to a water supply line that extends through an opening 82 in the deck 80. The assembly 20 includes a spout 22 removably connected to a mounting plate 44. A first and a second member 26 and 50, respectively, connect to non-rotatable nut member 64 carrying a retainer member 72 whereby, on shifting the nut member 64 toward the underside of the deck 80, the retainer member 72 will clamp the assembly 20 to the deck 80.

6 Claims, 11 Drawing Sheets

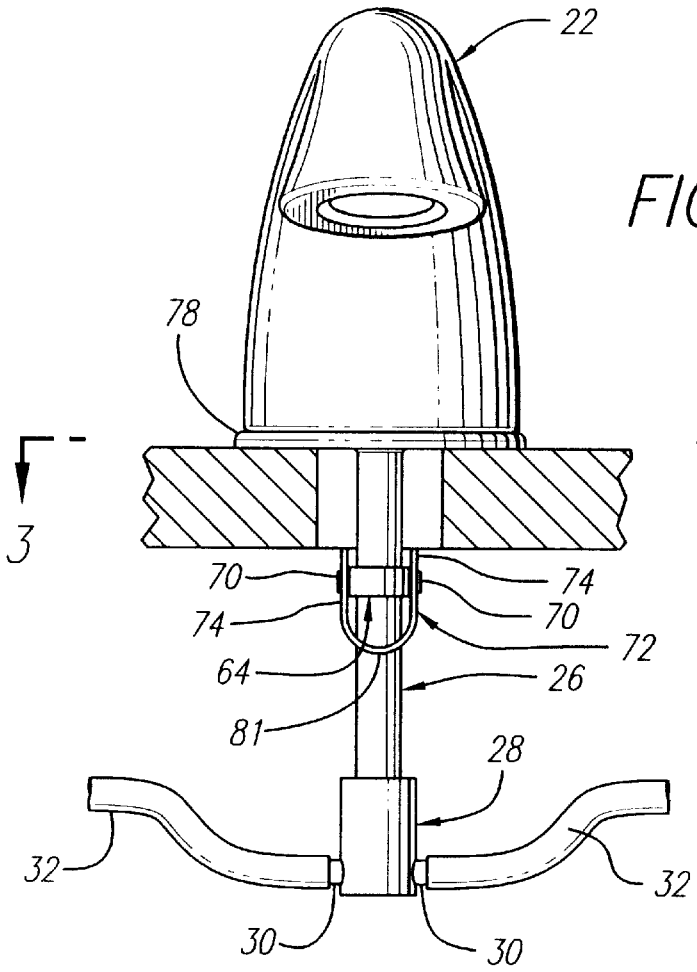
FIG. 2
FIG. 3
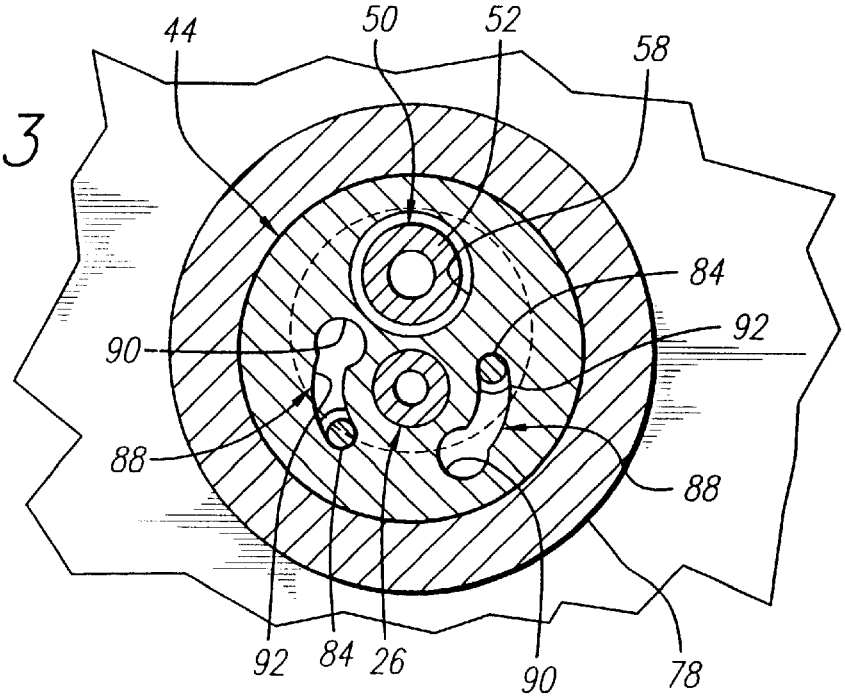

278
202

270
272
222
216
224
268
266
214
219
218
256
258
254
236
228
228
200
238
232
274
234
206
260
264
262
250
244
248
242
250
240
246
254
252

EASY CONNECT AND DISCONNECT FAUCET SPOUT ASSEMBLY

CROSS REFERENCE AND COPENDING PATENT APPLICATION

The present application is related to an earlier filed copending application owned by the same applicant, as follows:

U.S. Ser. No.: 09/133,460, now Pat. No. 5,946,746

Filed: Aug. 13, 1998

Title: QUICK CONNECT FAUCET ASSEMBLY

BACKGROUND OF THE INVENTION

The present invention relates generally to a faucet spout assembly, including the spout thereof, and, more particularly, to an easy connect and disconnect faucet spout assembly which can be mounted and/or removed from above the top of a deck to which the faucet spout assembly is connected.

BACKGROUND AND SUMMARY OF THE INVENTION

In conventional faucet assemblies, the mounting of the faucet assembly, including the spout thereof, is completed from, or requires, assembly components to be installed from the underside of the deck to which the faucet assembly is mounted. The assembly which is typically required to be performed from the underside of the deck is often awkward and uncomfortable for the installer.

It is an object of the present invention to provide an easy connect and disconnect faucet spout assembly that is mounted to the deck from above the deck, that is simple in construction, economical to produce and highly reliable in operation. It is another object of the present invention to provide a faucet spout assembly that permits the spout to be disassembled without disassembling the water supply lines. It is still another object of the present invention to provide an easy connect and disconnect faucet spout assembly for mounting and/or removing the spout from above the deck in a quick and easy manner with a minimum of tools or operations.

It is still another object of the present invention to provide a faucet spout assembly in which the spout is easily removed from the assembly and can be replaced with another spout of a similar style or a spout of a different style, if desired, without otherwise disassembling the faucet spout assembly or the water supply lines.

Accordingly, the present invention provides an easy connect and disconnect faucet spout assembly and, more specifically, a faucet spout assembly that is mounted from the top of the deck to which the faucet assembly is connected.

Further areas of applicability of the present invention will become apparent from the detailed description provided hereinafter. It should be understood, however, that the detailed description and specific examples—while indicating preferred embodiments of the invention—are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 2 is a front elevational view, partly in section, of a first embodiment of the faucet spout assembly according to the principles of the present invention;

FIG. 3 is a cross-sectional view taken along line 3—3 of FIG. 2;

DETAILED DESCRIPTION OF THE INVENTION

Figure 1:
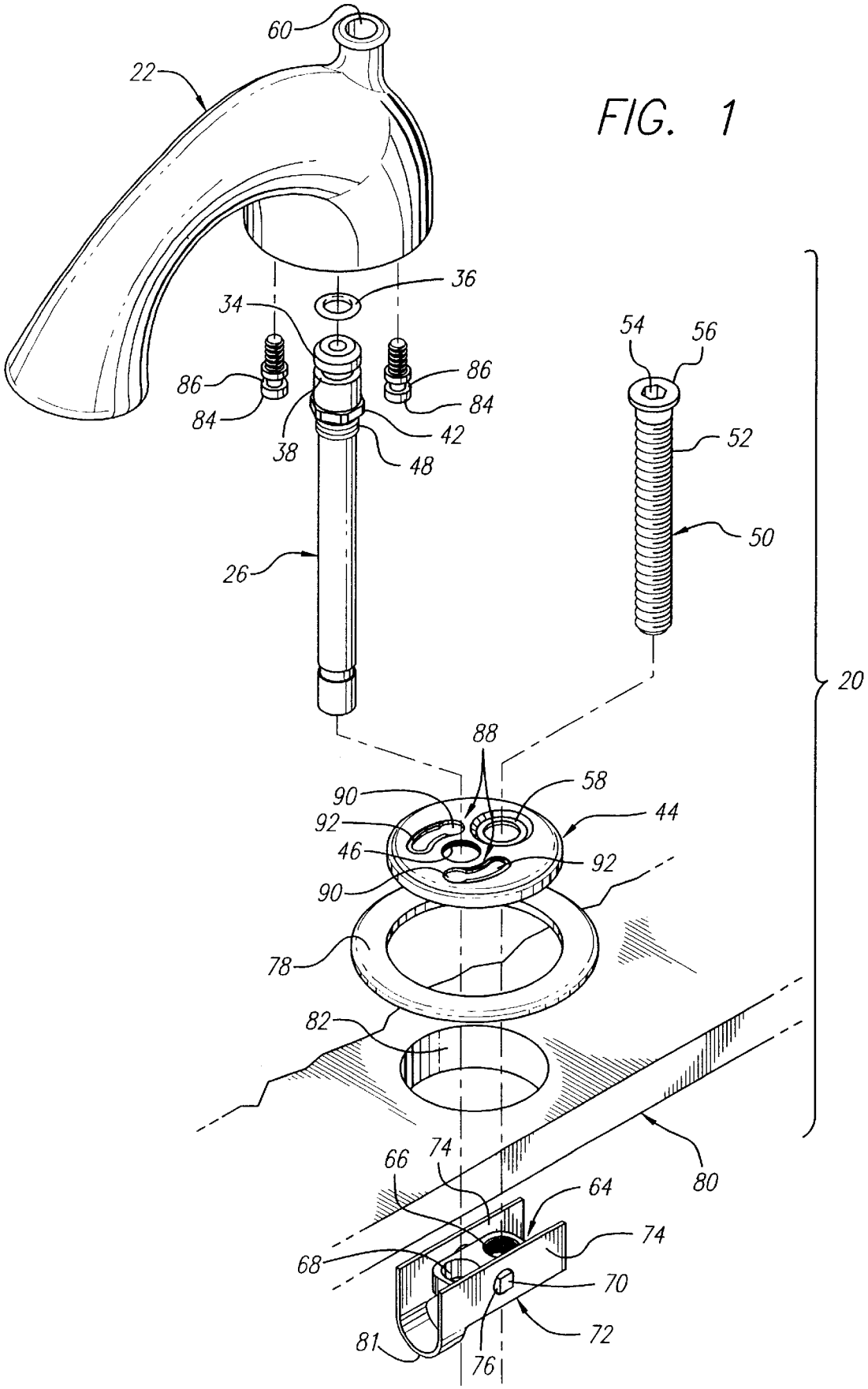
FIG. 1 is a perspective view of a first embodiment of the faucet spout assembly according to the principle of the present invention.

With reference to the accompanying drawings, the easy connect and disconnect faucet spout assembly according to the principles of the present invention will be described. The easy connect and disconnect faucet spout assembly 20 described herein includes a spout 22. However, it should be understood that the principles of the present invention may also be applied to any faucet spout assembly which has a similar or different spout and whether or not it includes a centerset faucet assembly with a spout and a pair of end body valve assemblies.

The first embodiment of the invention is shown in FIGS. 1–7 wherein the spout 22 includes a water passage 24 which communicates with a waterway tube 26 (first member) that is part of a water supply lines that, as shown in FIG. 2, connects into a T-joint connector 28 that has hose connector portions 30 connecting interconnecting hoses 32, each of which are connected into one of the valve assemblies (not shown).

Figure 4:
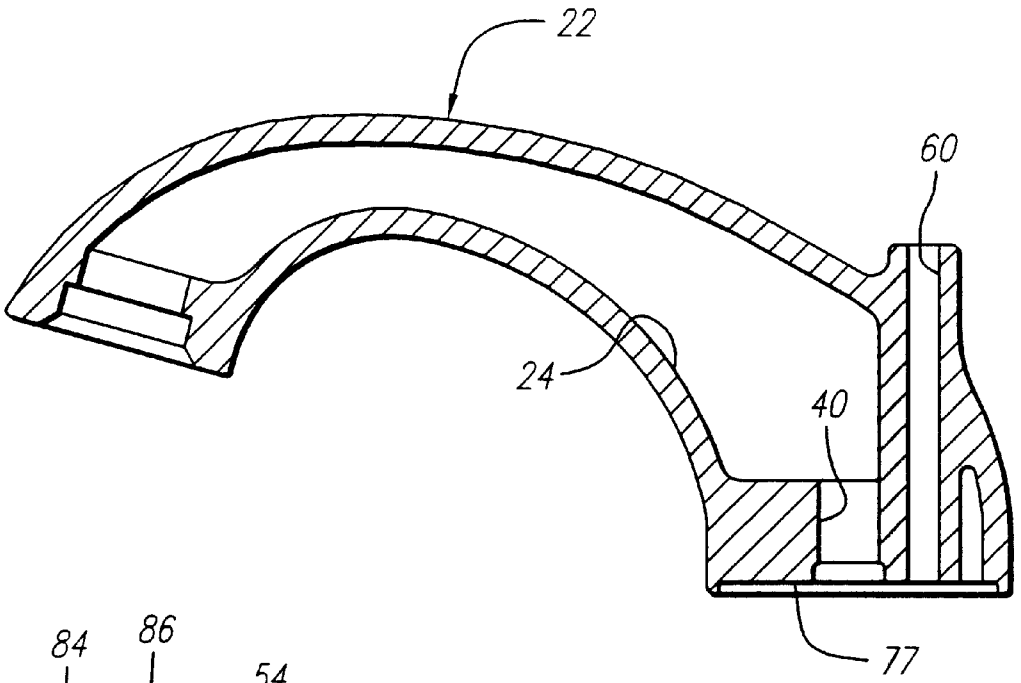
FIG. 4 is a sectional elevational view of the spout illustrated in the drawings and taken along a mid-line of its length.
Figure 6:
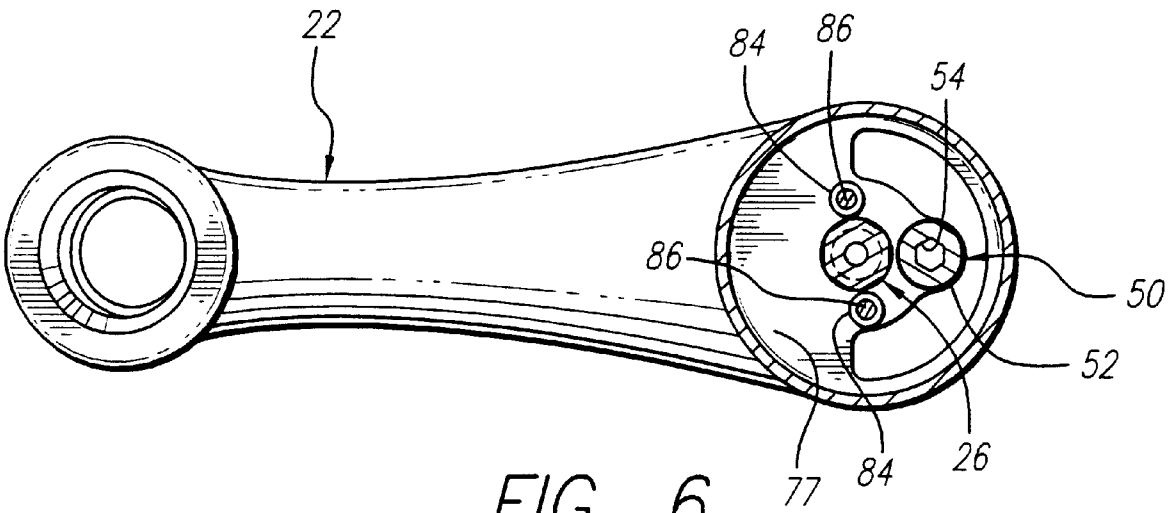
FIG. 6 is a cross-sectional view taken along lines 6—6 of FIG. 5.
Figure 5:
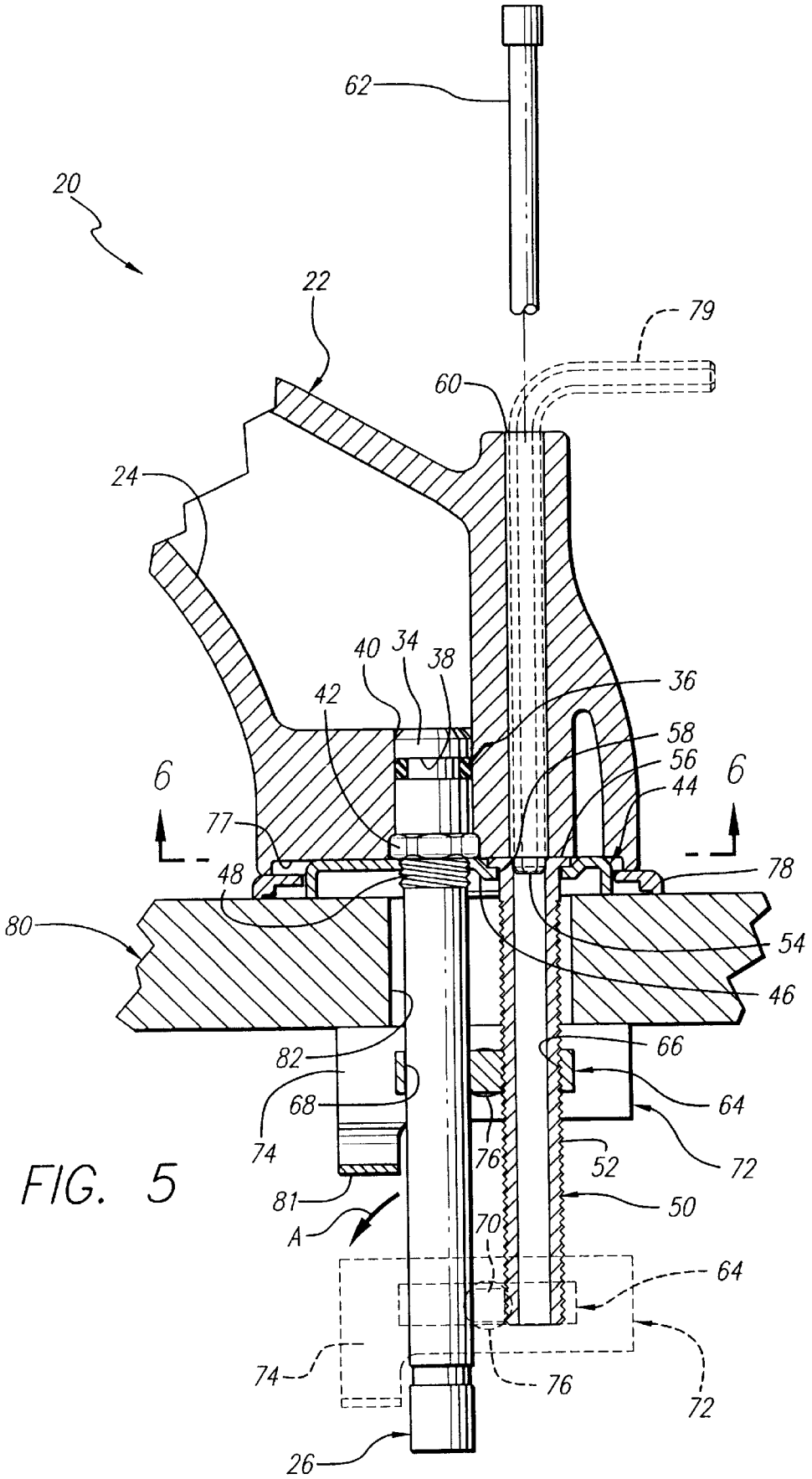
FIG. 5 is a partial side elevational view of the first embodiment of the faucet spout assembly according to the principle of the present invention.
Figure 7:
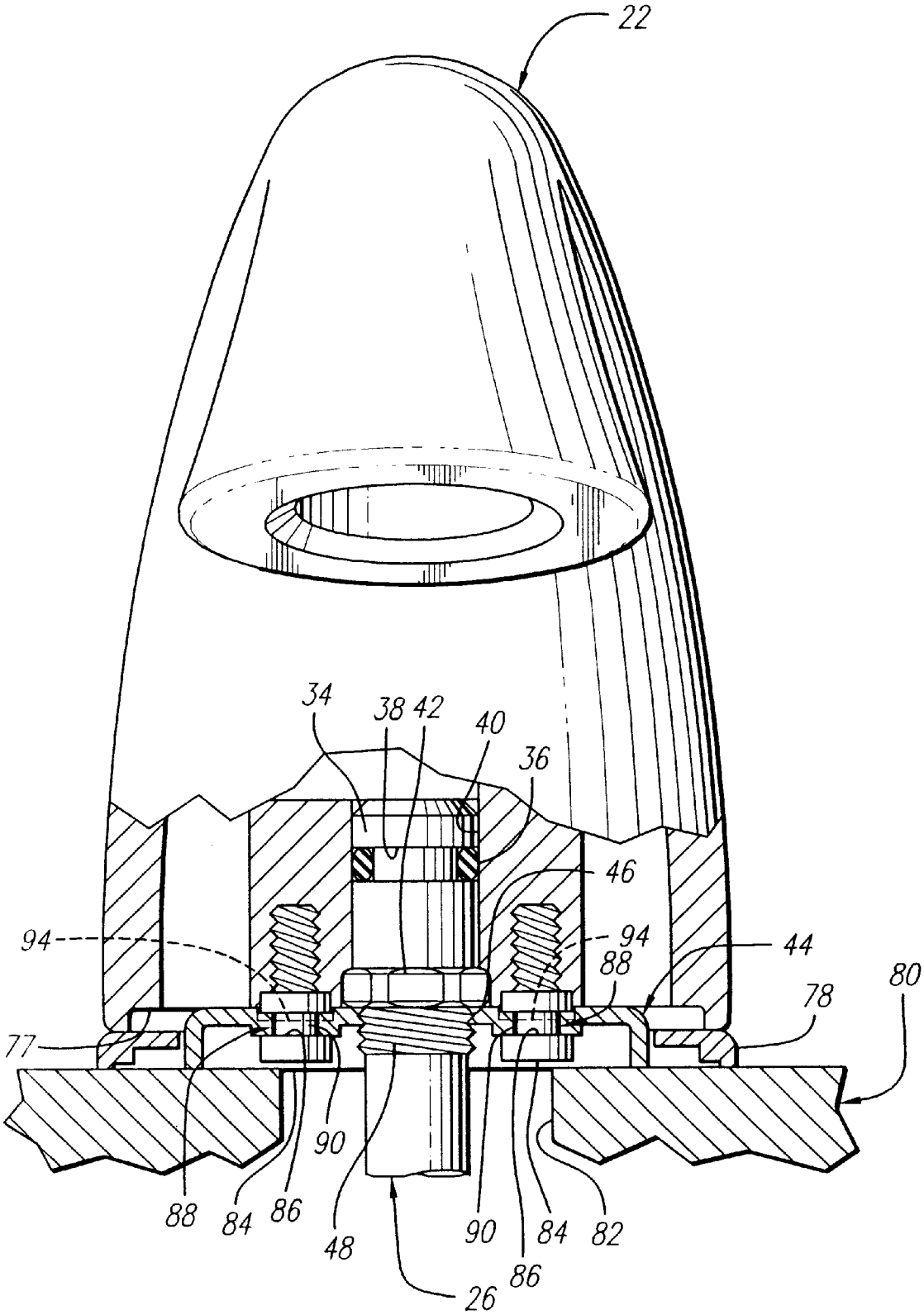
FIG. 7 is a front elevational view, partly in section, of the first embodiment of the faucet spout assembly according to the principles of the present invention.

The waterway tube 26, as shown in FIGS. 1, 5 and 7, has an end portion 34 which carries an O-ring 36 disposed in a recess 38. The end portion 34 is disposed in a passageway 40 in communication with the water passage 24 with the connection being sealed by the O-ring 36. The waterway tube 26 includes a radially extending hexagonal flange portion 42. The bottom of the passageway 40 has a enlarged diameter sized to receive the hexagonal flange portion 42, as shown in FIGS. 4, 5 and 7. A mounting plate 44 is provided with a threaded opening 46, as shown in FIGS. 1, 5 and 7, and receives a threaded portion 48 of the waterway tube 26. The hexagonal flange portion 42 can be engaged by a wrench to tighten and affix the waterway tube 26 into the mounting plate 44 at the opening 46.

A threaded rod 50 (second or third member), shown in FIGS. 1 and 5, is provided with a hollow cylindrical body 52 that terminates with an internal hexagonal engagement portion 54 at its top and which is externally threaded along its length and is provided with an upper radially extending flange 56. The threaded rod 50 extends through a second opening 58 in the mounting plate 44, while flange 56 rests against the mounting plate 44. The threaded rod 50 is aligned with an opening 60 in the spout 22 which allows access of an alien wrench 79, shown in dotted line in FIG. 5, for engaging the internal hexagonal engagement portion 54 provided at the top of the threaded rod 50. In the completed faucet assembly, a pop-up rod 62, shown raised above the opening 60 in FIG. 5, is adapted to extend through the opening 60 of the spout 22 and through the central opening of the threaded rod 50. As is well known in the art, the pop-up rod 62 engages a drain stopper assembly (not shown) for opening and closing the drain stopper.

A nut member 64 is threadedly engaged with the threaded rod 50. As shown in FIGS. 1 and 5, the nut member 64 includes a threaded opening 66 which engages the threaded rod 50 and a second opening 68 which slidably receives the waterway tube 26 and acts to prevent the nut member 64 from rotation. The nut member 64 also includes two pivot arms 70, only one of which is shown in FIG. 1, which extend from opposite sides of the nut member 64. A retainer bracket or member 72 is pivotally mounted to the nut member 64. The retainer member 72 includes a pair of generally parallel arms 74 having centrally located pivot openings 76. A cross bar 81 extends between the arms 74, as shown in FIGS. 1 and 5. The pivot arms 70 of nut member 64 extend through pivot openings 76 of retainer member 72 for pivotally supporting the retainer member 72 thereon. It should be noted that the nut member 64 can be modified to include a pivot pin extending therethrough for supporting the retainer member 72.

As shown in FIGS. 1, 5 and 7, a decorative flange 78 is disposed outwardly of the mounting plate 44 which, in assembled position, the plate 44 is disposed in a central recess 77 formed at the bottom of the spout 22.

With reference to FIGS. 1 through 7, the installation of the spout 22, according to the principles of the first embodiment of the present invention, will now be described. The spout 22 is mounted to a deck or mounting surface 80 which is provided with an opening 82 for receiving the threaded rod 50 and waterway tube 26 of the faucet spout assembly 20. The retainer member 72 will be pivoted to a generally vertical position to extend substantially longitudinally (not shown) with the waterway tube 26 and threaded rod 50 such that the cross bar 81 will rest against the waterway tube 26. The faucet spout assembly 20 can be optionally tilted clockwise from the representation of FIGS. 2 and 5 so that the cross bar 81 of the retainer member 72 is stable against the waterway tube 26. Otherwise, the installer can hold the retainer member 72 in the vertical position upon insertion through the opening 82. After the retainer member 72 passes through the opening 82 in the deck 80 and the spout 22 is positioned such that the threaded rod 50 and waterway tube 26 extend generally vertically, the weight of the cross bar portion 81 of the retainer member 72 causes the retainer member 72 to rotate in a direction of arrow A, as shown in FIG. 5, until the cross bar 81 contacts the waterway tube 26 in a generally horizontal position which is shown in both solid and dotted line representation in FIG. 5.

The spout 22, as shown in FIGS. 1, 3, 6 and 7, has a pair of studs 84 which are connected into tapered holes 86 formed in the bottom of the spout 22 on either side of the passageway 40. The studs have a recess 86 formed below the head thereof. The mounting plate 44 has a pair of keyholes 88, best shown in FIGS. 1 and 3, with an enlarged opening 90 and a smaller opening 92 which is arcuate and has a radius measured from the axis of the threaded opening 46. The upper surface of the opening 92 is cammed with a gently raising surface, as at the dotted line 94 shown in FIG. 7, wherein the studs will align with and be placed in the openings 90 to place the recesses 86 in line with the openings 92 so that, upon rotation of the spout 22, the studs 84 will engage to cams 94 of the openings 92 to be affixed to the mounting plate 44 to connect the spout 22 to the mounting plate 44.

The allen wrench 79, shown in FIG. 5 in dotted line representation therein, can be inserted through the opening 60 in the spout 22 to engage the hexagonal portion 54 of the threaded rod 50. The threaded rod 50 can then be turned in order to draw the nut member 64 and retainer member 72 in an upward direction so that the end portions of the parallel arms 74 of the retainer member 72 engage the underside of the deck 80 at four points spaced about opening 82, as best shown in FIG. 5. Thereafter, the pop-rod 58 will be slidably received in the opening in the threaded rod 50 and can be easily removed so that the allen wrench 79 can be inserted through the opening 60 of spout 22 to engage the hexagonal portion 54 of the threaded rod 50.

The waterway tube 26 is engaged in the passageway 40 of the spout 22 and affixed to the mounting plate 44 that is disposed upon the top side of the deck 80 so that, when the retainer member 72 engages the underside of the deck 80, the faucet spout assembly 20 will be mounted to the deck 80. Each of the water tube 26 and the threaded rod 50 have flanges that force the mounting plate 44 against the deck 80 while the retainer member 72 also is clamped against deck 80, thus locking the faucet spout assembly 20 in mounted position upon the deck 80. This is in addition to two studs 84 locking the spout 22 to the mounting plate 44.

Once assembled, the spout 22 can be removed or changed with a similar or different spout by rotating the spout 22 with the studs 84 and lifting the studs 84 out the keyholes 88 and, also, disconnecting the pop-up rod 62 and the waterway tube 26 therefrom. Reconnecting a spout can be done by reversing the disconnecting operations, and this is done to reassemble the faucet spout assembly 20 without requiring the water supply line from being disconnected.

Figure 8:
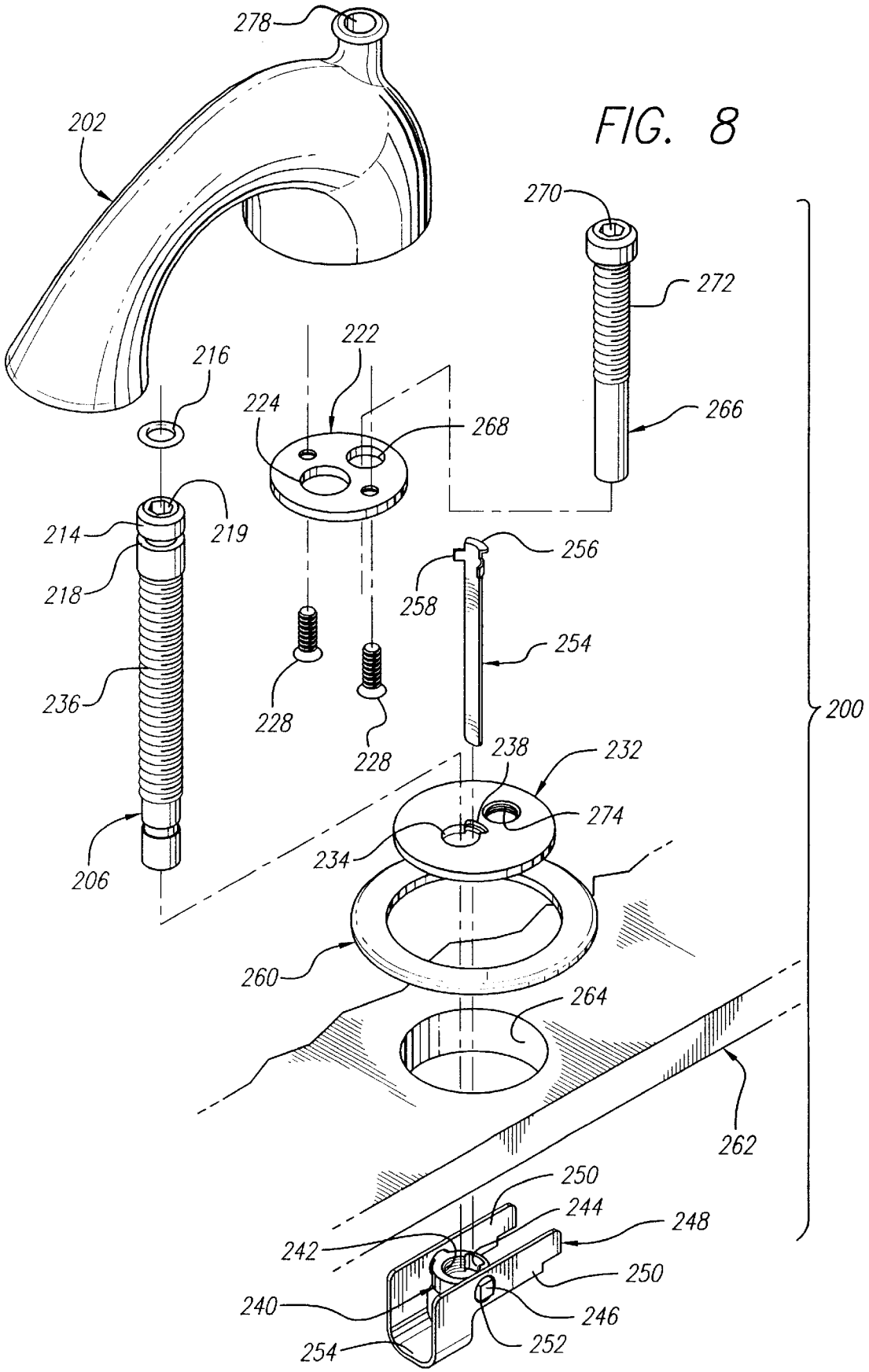
FIG. 8 is a perspective view of a second embodiment of the faucet spout assembly according to the principles of the present invention.
Figure 9:
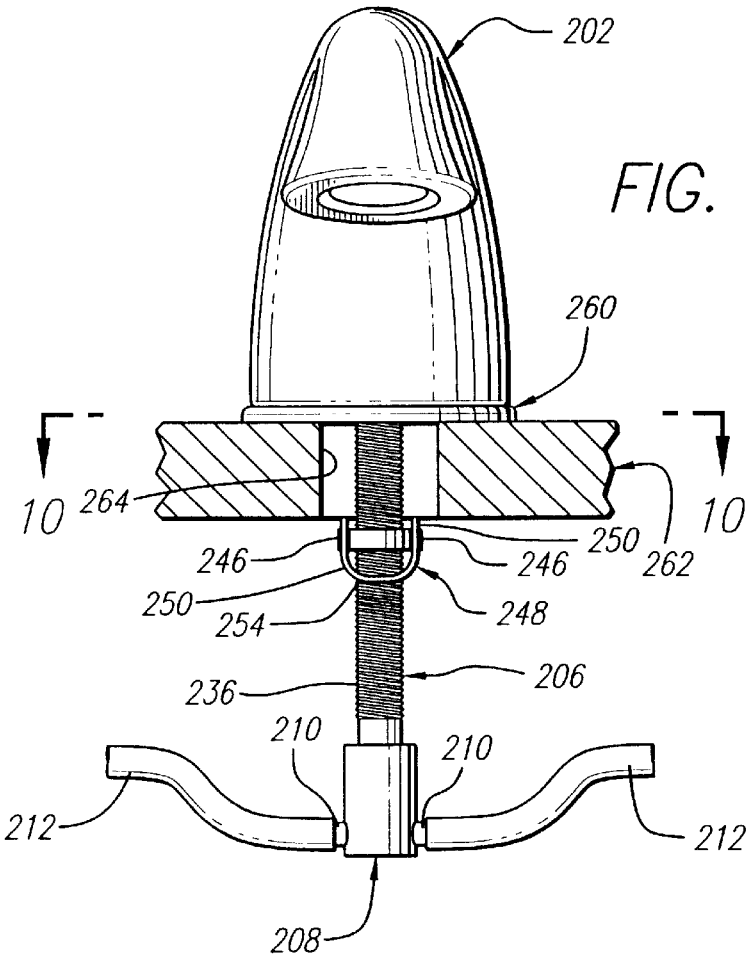
FIG. 9 is a front elevational view, partly in section, of the second embodiment of the faucet spout assembly according to the principles of the present invention.
Figure 10:
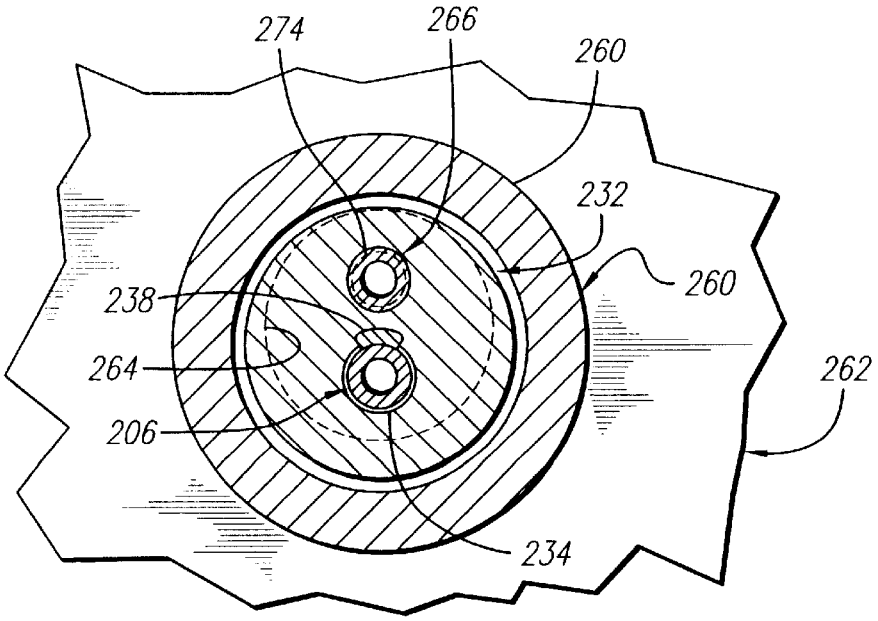
FIG. 10 is a cross-sectional view taken above line 10—10 of FIG. 9.
Figure 11:
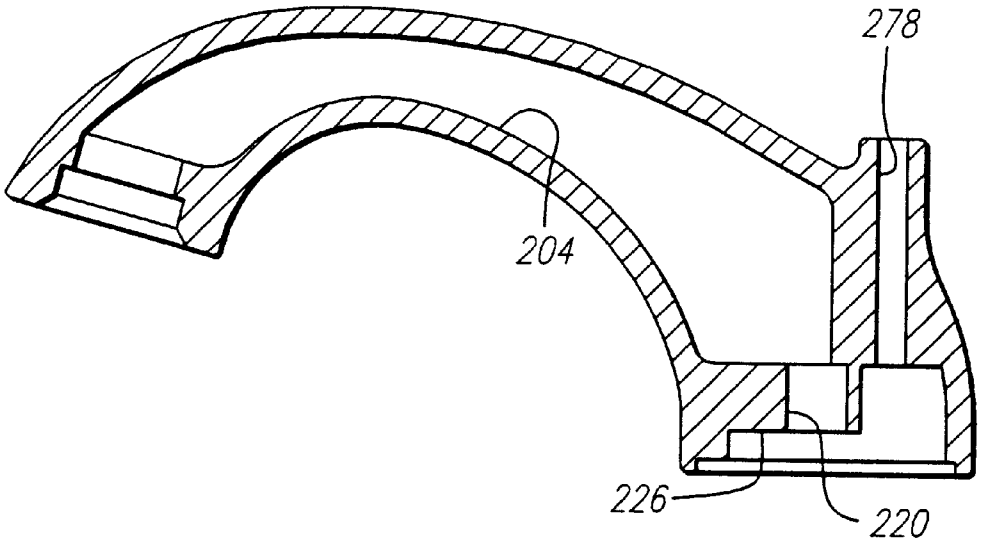
FIG. 11 is a sectional elevational view of the spout illustrated in the drawings and taken along a mid-line of its length.
Figure 15:
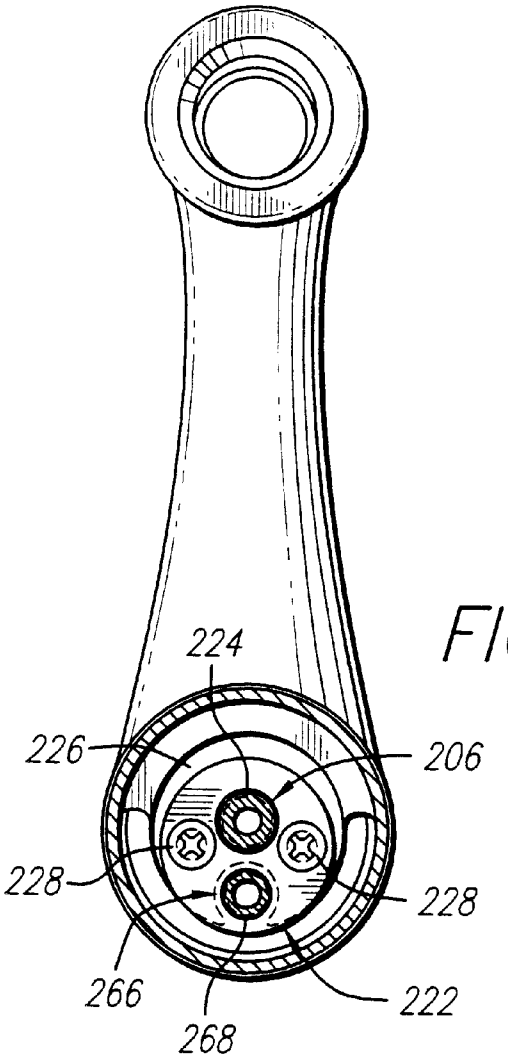
FIG. 15 is a cross-sectional view taken along line 15—15 of FIG. 14.
Figure 12:
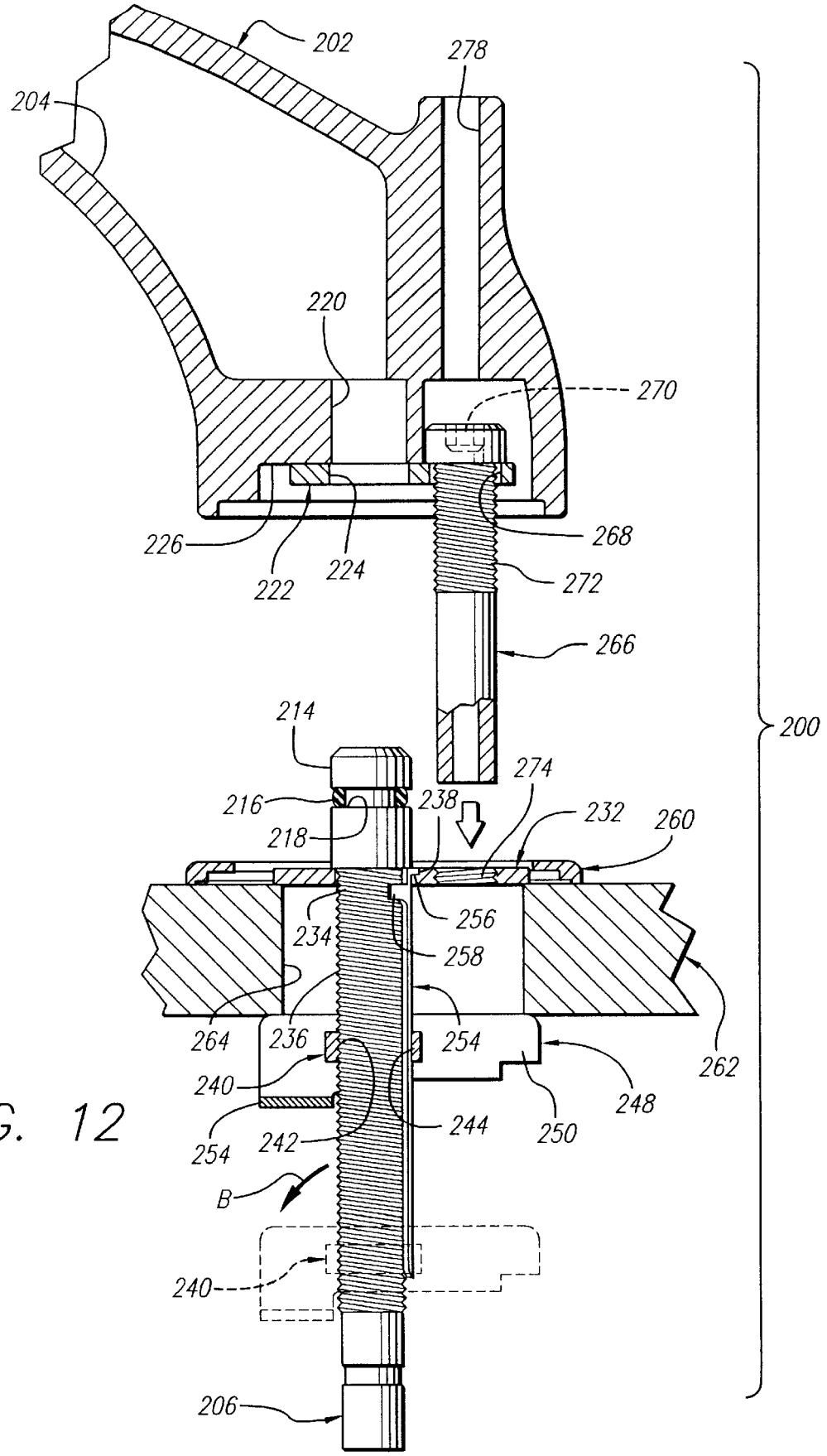
FIG. 12 is a partial side elevational view of the second embodiment of the faucet spout assembly with the waterway tube of the water supply lines, connected to the deck, and the spout and rod thereto is disposed in position to be connected, but not yet connected, to the deck.
Figure 13:
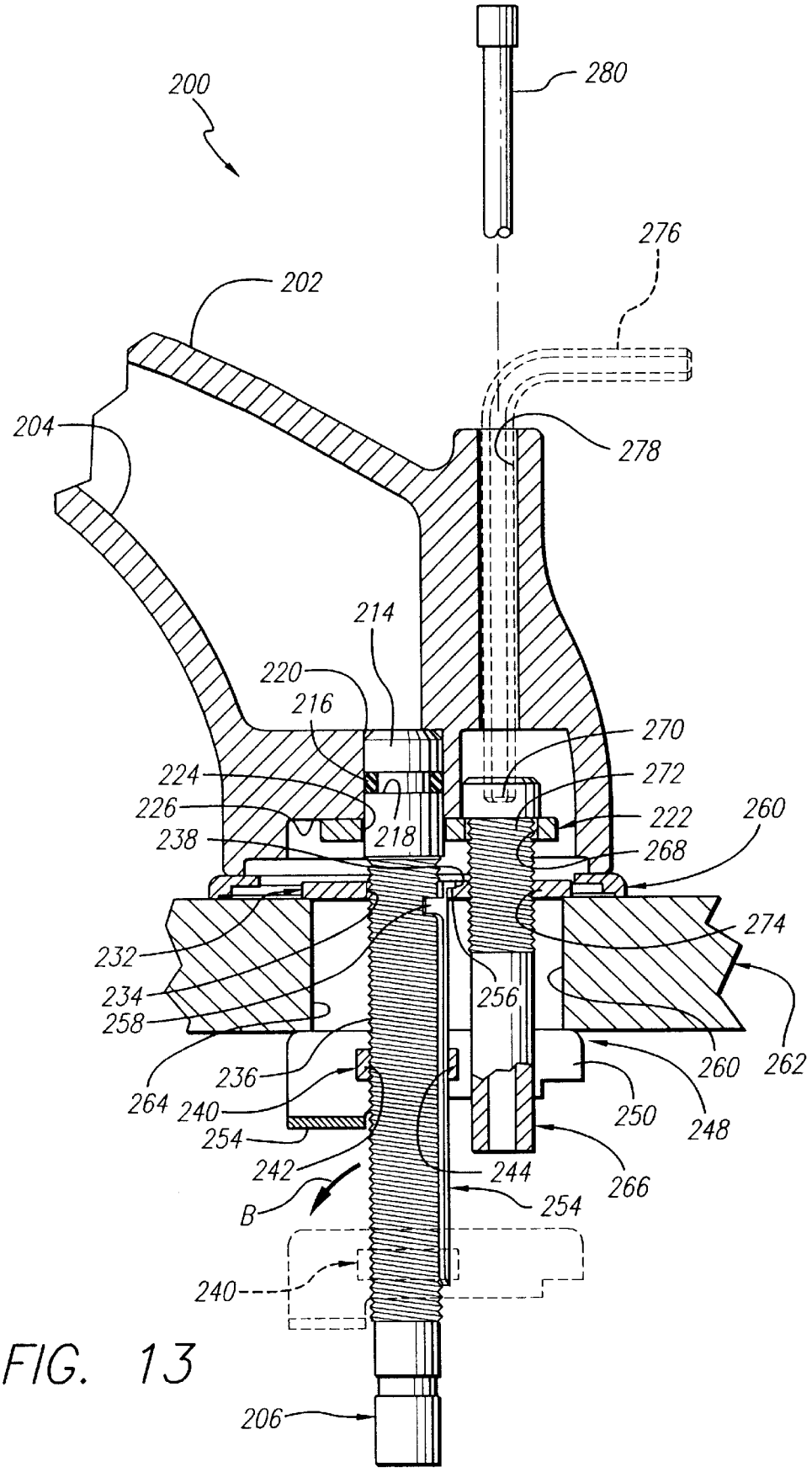
FIG. 13 is a partial side elevational view of the second embodiment of the faucet spout assembly in which the faucet spout assembly is connected to the deck according to the principles of the present invention.
Figure 14:
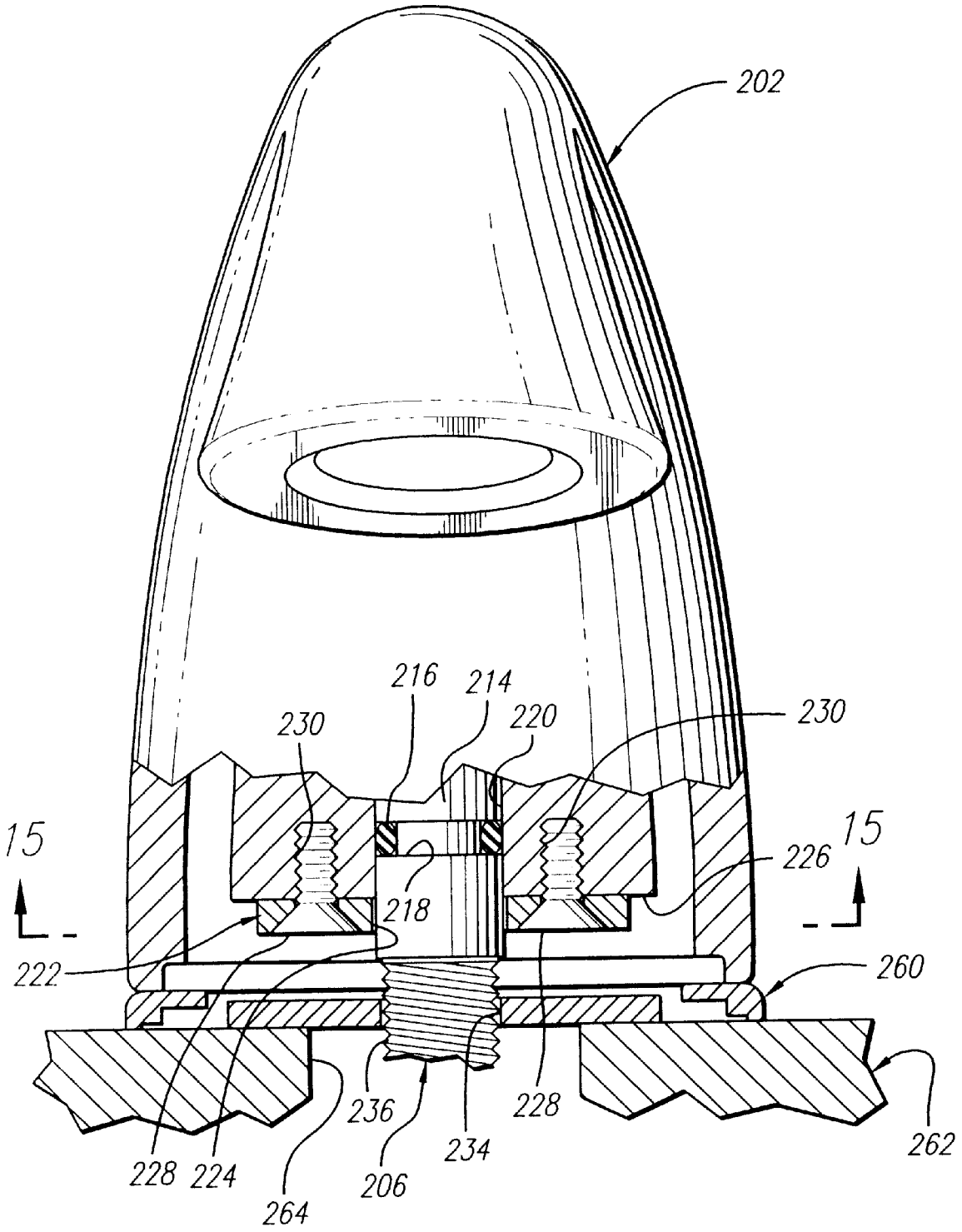
FIG. 14 is a front elevational view, partly in section, of the second embodiment of the faucet spout assembly according to the principles of the present invention.

With reference to the second embodiment of the present invention, this embodiment is illustrated in FIGS. 8 through 14 wherein a faucet spout assembly 200 includes a spout 202 with a water passage 204, shown best in FIG. 11, which communicates with a waterway tube or first member 206 that is part of the water supply lines that, as shown in FIG. 9, connects into a T-joint connector 208 that has hose connector portions 210 connecting interconnecting hoses 212 which are separately connected into the water valve assemblies (not shown). The waterway tube 206, as shown in FIGS. 8, 9, 12, 13 and 14, has an end portion 214 which carries an O-ring 216 disposed in a recess 218. The end portion 214 is disposed in a recess 218. The end portion 214 is disposed in a passageway 220, shown in FIGS. 11, 13 and 14, in communication with the water passage 204 with the connection being sealed by the O-ring 216. The waterway tube 206 includes a hexagonal engagement portion 219 formed internally at the top of the opening of the tube 206. A spout plate 222, shown in FIGS. 8 and 15, has an opening 224 and is connected to the spout 202 in a recess 226 therein below the passageway 220 which is in alignment with the opening 224. The opening 224 is sized to receive the end portion 214 of the waterway tube 206. A pair of screws 228 connected in tapered holes 230 affix the spout plate 222 to the spout 202. A mounting plate 232, shown in FIGS. 8, 10, 12, 13 and 14, has an opening 234 that receives the waterway tube 206 to end portion 214 that has a larger diameter than that of a threaded portion 236 therebelow so that the tube 206 can extend into, but not pass through, the opening 234, but the threaded portion 236 easily passes through and is free to rotate therein. As best seen in FIGS. 8 and 13, an arcuate recess 238 is formed on the top surface of the mounting plate 232 to extend into the opening 234.

A nut member 240 has a threaded opening 242 that is threadedly engaged with the threaded portion 236 of the waterway tube 206 and an axial recess 244 that runs the full length of the threaded opening 242, as is shown in FIGS. 8, 12 and 13, for purposes more fully explained hereinafter. The nut member 240 also includes two pivot arms 246; only one of which is shown in FIG. 8 which extend from opposite sides of the nut member 240. A retainer bracket or member 248 is pivotally mounted to the nut member 240. The retainer member 248 includes a pair of generally parallel arms 250 having centrally located pivot openings 252. A cross bar 254 extends between the arms 250, as shown in FIGS. 8, 12 and 13. The pivot arms 246 of the nut member 240 extend through the pivot openings 252 of the retainer member 248 from pivotally supporting the retainer member 248 thereon. It should be noted that the nut member 240 can be modified to include a pivot pin extending therethrough for supporting the retainer member 248.

A second member 254 is long, thin and straight with a top tab 256 and a pair of short arcuate ears 258 that are formed to extend radially outwardly on either side of its length a short distance below the top thereof. The second member 254 is placed into the opening 234 before the waterway tube 206 so that the top tab 256 is disposed the recess 238 to hold it in engagement in the mounting plate 232. The lower end of the second member 254 is disposed into the recess 244 of the nut member 240. When the waterway tube 206 is disposed through the mounting plate 232 into engagement with the threaded opening 242 of the nut member 240. The second member 254 is now non-removable from the mounting plate 232, being locked therein by both the tab 256 and the ears 258 which cooperate to prevent the second member 254 from being raised or lowered therefrom. The second member 254 engages the nut member 240 to prevent it from rotating upon rotation of the waterway tube 206.

A decorative flange 260 will be placed on the top side of a deck 262 about an opening 264, as shown in FIGS. 8, 10, 12, 13 and 14. The mounting plate 232 is engaged by the second member 254 and the first member 206 which in turn engage with the nut member 240. The mounting plate 232 is mounted to the deck 262 by disposing the vertically raised retainer member 248 through the opening 264 and, thereafter, it will be gravity pivoted to a generally horizontal position by rotating in the direction of arrow B, shown in FIG. 12. An allen wrench 276 (shown only in dotted line representation in FIG. 13) will engage the hexagonal opening 219 of the waterway tube 206, rotate the same and shift the nut member 240 upwardly to clamp the pair of arms 250 of the retainer member 248 across the underside of the opening 264 and the deck 262. Next, as shown in FIGS. 1, 12 and 13, a hollow rod or third member 266 is rotatably disposed in an opening 268 of the spout plate 222. The rod 266 has an enlarged head formed at the upper end; the top of which has a hexagonal engagement portion 270. A threaded portion 272 extends below the head to be threadedly engaged in a threaded opening 274 of the mounting plate 232 upon engagement by the allen wrench 276 shown in dotted line representation in FIG. 13 which is disposed through an opening 278 in the spout 202 to engage the hexagonal portion 270 of the rod 266. Once the spout 202 is mounted to the deck 262, a pop-up rod 280, shown only in FIG. 13, will be slidably received in the opening in the rod 266 and can be easily removed whenever it is desirable to remove or replace the spout 202.

Once again, whenever desired, the spout 202 can be removed or changed with a similar or different spout by merely disconnecting the rod 266 from engagement from the mounting plate 232. With the pop-up rod 280 removed, lifting the spout 202 will disconnect the waterway tube 206 without the need to otherwise disassemble the water supply lines.

In general, the above-identified embodiments are not to be construed as limiting the breadth of the present invention. As stated earlier, modifications or other alternative constructions will be apparent which are within the scope of the invention as defined in the appended claims.

What is claimed is:

1. A faucet spout assembly mountable to a deck from above an opening therein and connectable to a water supply line extending through the deck opening, comprising:

a.) a mounting plate disposed above the deck opening and engageable with a first member extendable through the deck opening;

b.) a second member engageable with the mounting plate to lie in a first plane parallel to the first member with the second member extendable through deck opening;

c.) a threaded portion formed on the first member and the second member;

d.) a nut threadedly engaged with the threaded portion of one of the members and the other member engaging the nut to prevent rotation thereof so that during rotation of the threaded member, the nut will be shifted up or down along the length of the threaded portion of the one member;

e.) a retainer member having at least one leg having a longitudinal axis pivoting in a second plane substantially parallel to the first plane and pivotally connected to the nut and gravity balanced to assume a free position across the nut when the nut is below and shiftable upwardly toward the deck;

f.) the retainer member having a greater length than the diameter of the deck opening whereby the retainer member engages and clamps against the underside of the deck, with the mounting plate clamped against the top side of the deck when the nut is shifted, to cause the retainer member to engage the deck; and g.) a spout removeably connected to the mounting plate to receive and discharge water from the water supply line.

2. The combination claimed in claim 1 wherein:

a.) the first member is the water supply line;

b.) the first member has the threaded portion and threadedly engages the nut;

c.) a spout plate is affixed to the spout; and d.) a third member is rotatably mounted in the spout plate and engageable with the mounting plate whereby, on rotation of the third member, the spout to be connectable to the faucet spout assembly upon being clamped thereto.

3. The combination claimed in claim 1 wherein:

a.) the first member is the water supply line;

b.) the second member has the threaded portion and threadedly engages the nut;

c.) a pair of stud affixed to the spout radially spaced from the axis of the first member;

d.) a pair of openings formed in the mounting plate sized to receive the studs therein; and e.) the pair of studs removeably connected in the pair of openings to connect the spout to the mounting plate.

4. A faucet spout assembly mounted to a deck from above comprising:

a.) an opening formed in the deck;

b.) a mounting plate extending over the opening above the deck;

c.) a water supply line extending through the opening and affixed to the mounting plate;

d.) a second member extending through the opening and rotatably engaged with the mounting plate;

e.) the second member having a threaded portion;

f.) a nut threadedly engaging the threaded portion of the second member;

g.) the water supply line engaging the nut to prevent its rotation upon rotation of the second member whereby the nut will be axially shiftable along the second member when the second member is rotated.

h.) a retainer member disposed below the mounting plate to be pivotally disposable across the opening below the deck and pivotally connected to the nut and, upon shifting the nut toward the deck, the retainer member and the mounting plate to be clamped against the deck; and i.) a spout removeably connected to the mounting plate to receive and discharge water from the water supply line.

5. The combination claimed in claim 4 wherein:

a.) the spout having a pair of studs affixed thereto;

b.) the mounting plate having a pair of openings therein formed in spaced relationship to the water supply line; and c.) the openings to receive the studs therein to removeably connect the spout to the mounting plate.

6. The combination claimed in claim 5 wherein:

a.) each of the openings spaced an equal distance from the water supply line;

b.) each of the openings formed in the shape of a keyhole having a larger and a smaller opening; and c.) each of the stud having an annular recess formed below a head whereby the head is insertable into the larger opening of the keyhole and, upon arcuate shifting of the spout, the recess of the studs to enter the smaller opening of the keyhole.

* * * * *